United States Patent [19]

Juba

[11] 4,132,043

[45] Jan. 2, 1979

[54] STRUCTURAL UNITS

[75] Inventor: Bernard T. Juba, White Bear Lake, Minn.

[73] Assignee: H. B. Fuller Company, St. Paul, Minn.

[21] Appl. No.: 770,634

[22] Filed: Feb. 22, 1977

[51] Int. Cl.[2] ..... E04C 2/26

[52] U.S. Cl. ..... 52/309.17; 52/600; 264/134; 264/256; 428/446; 428/517; 428/518; 52/235

[58] Field of Search ..... 52/309.3, 309.17, 309.16, 52/600, 597, 598, 235; 428/446, 517, 518; 264/134, 256

[56] References Cited

U.S. PATENT DOCUMENTS

| | | | |
|---|---|---|---|
| 3,315,424 | 4/1967 | Smith | 52/309.3 |
| 3,334,460 | 8/1967 | McShane | 52/309.3 |
| 3,449,880 | 6/1969 | Bailey | 52/309.17 |
| 3,642,559 | 2/1972 | Stokes | 52/309.12 |

FOREIGN PATENT DOCUMENTS 1228056 4/1971 United Kingdom.

*Primary Examiner*—John E. Murtagh
*Attorney, Agent, or Firm*—Norman P. Friederichs

[57] ABSTRACT

A precast concrete structural unit is provided including a concrete sub-unit and a plastic resinous sheet. The sheet is adhered to the sub-unit at the time of pouring the concrete utilizing contact adhesive, preferably polychloroprene cement. The structural unit may further include adhesive coated reinforcement.

9 Claims, 7 Drawing Figures

STRUCTURAL UNITS

BACKGROUND OF THE INVENTION

The present invention relates to concrete construction and more particularly to precast concrete structural units.

Concrete as a construction material has a long and interesting history. Although concrete is often thought of as being of recent origin, its history actually dates back to the early Romans who used a crude form of concrete in construction of the aqueducts. Steel reinforced concrete was in use during the 19th century. The first documented modern use of precast concrete was in the cathedral Notre Dame du Haut which was constructed in France in 1923. In that instance the precast concrete structural units were screen walls.

Precast, concrete structural units have been used in a wide variety of environments. Perhaps the earliest use of such precast units was a screen to provide a certain degree of privacy. Precast wall panels for use in buildings have been provided which carry no loads other than perhaps the force exerted by wind. Such precast wall panels typically have a height equivalent to the floor-to-floor dimension of the building in which they are incorporated. Precast wall panels, in a wide variety of sizes, shapes and finishes have been used.

Precast wall panels have also been used as load bearing units. Reinforcement, particularly with steel, becomes a major importance when precast wall panels are so used. Precast wall panels may also be used as wall supporting units, formwork and as shear walls extending over a plurality of floors or levels in a building. Various other precast concrete structural units have been known such as street furniture, planters, lighting standards, ornamental work, art and sculpture.

Precast concrete structural units have certain significant advantages over other structural materials. Perhaps one of the more important is that of providing a wide range of design expression in architecture. The quality control of precast concrete can be closely controlled thus providing material often superior in quality to poured concrete.

Precast concrete structural units generally are prepared by pouring wet mix concrete into suitably-shaped, reusable mold forms. The mold forms typically are made of steel and may be one piece molds or multipiece molds, the latter being disassembled for removal of the poured concrete panel.

In the past some structural units have been provided with decorative surfaces. Perhaps the most prevalent decorative surface is provided by preparing the concrete utilizing a white sand resulting in a finished product which is very light in color. Other surfacing has been provided by washing away a portion of the concrete leaving exposed aggregate.

GENERAL DISCUSSION OF THE PRESENT INVENTION

The present invention provides a structural unit of concrete having an exposed decorative surface of plastic or resinous sheet adhered to the concrete with a contact adhesive, the concrete being set while in contact with the sheet and simultaneously bonded thereto. In the present invention it was discovered that a single component adhesive may be utilized in construction of structural units. In the present invention dry-to-the-touch adhesives may be applied to a plastic surface sheet, the surface sheet placed in a suitable mold form and wet-mix, flowable or pourable concrete placed into the mold to form the substructure i.e. subunit of the structural unit. The dry-to-the-touch adhesive provides a strong bond between the surface sheet and the cured concrete. The bond will withstand weathering and substantial temperature variation.

It was further discovered that such adhesives may be used to coat the reinforcing material and hardware in the structural units. This bonding permits placement of the reinforcement at any location within the poured concrete. For example, the reinforcement may be adhered to the plastic sheet and held in place by the adhesive during pouring of the concrete.

In the present invention it was unexpectly discovered that the contact adhesive will bond the sheet to concrete which is wet poured. The contact adhesive provides an organic hydrophobic film, thus one would not expect such bonding. In most instances one must apply the contact adhesive to both surfaces to be bonded. In the present invention it is only necessary to apply the adhesive to one surface, namely, the plastic sheet. In most uses of contact adhesives the bonding must occur within 20 minutes of application. In the present invention suitable bonds have resulted when concrete was poured even two hours after application of adhesive to the sheet.

The present invention provides advantages over the prior structural units by providing highly decorative panels. The present method provides improved efficiencies due to lower cost materials, reduced labor costs and improved quality control.

The substructure of the present unit may be prepared from any suitable mix of heavy or light-weight aggregate and Portland cement. Typically, the mix will provide concrete having a compression strength of not substantially less than 4500 PSI (pounds per square inch) tested in accordance with ASTM C 192. In some instances, one may use concrete having less compression strength, particularly if reinforcing is included. The concrete mix will further include water in an amount sufficient to provide a flowable mixture.

The plastic surface sheet may be of any suitable plastic sheet material such as polyvinyl chloride, polystyrene, ABS (acrylonitrile butadiene stryene), styrene and acrylic. Of course other suitable sheet material may be used such as thermoplastic or thermosetting sheet material. The plastic sheet may typically have a thickness of at least about 0.01, generally at least 0.02 inches. The sheet may be of any desired shape, for example, flat or corrugated. The sheet may be of any desired color, for example it may be a single color such as white or a plurality of colors such as variegations of yellow and blue. Although the sheet of the structural unit is described as being decorative, it is to be recognized that the plastic sheet may also serve other purposes. For example, the structural unit may include a plastic sheet in order to provide a smooth, non-abrasive surface. The structural unit may provide, for example, sanitary surfaces in creameries, dairies and food processing plants.

The adhesive may be any dry-to-the-touch adhesive which will bond both to the plastic sheet material and to the wet poured concrete. The adhesive preferably is a polychloroprenephenolic resin adhesive.

The contact adhesive of the present invention may be a polychloroprene cement. Polychloroprene cements generally are known, see British Pat. No. 1,228,056. Polychloroprene cements may be prepared by dissolving polychloroprene in a suitable solvent and compounding the dissolved neoprene with a phenol formaldehyde resin and various alkaline earth oxides such as zinc oxide or magnesium oxide.

Polychloroprene, as used herein, means polymerized chloroprene and copolymers of chloroprene with minor amounts of other monomers such as isoprene, butadiene, acrylonitrile and the like. The polychloroprene may be polymerized 2-chloro-1,3-butadiene having a molecular weight on the order of 100,000 to 300,000. One suitable type is Neoprene type W. TM The polychloroprene may be in the form of an elastomer blend including 2 to 40 percent halogenated butyl rubber and 98 to 60 percent polychloroprene.

The phenol formaldehyde resin may be prepared from monohydric phenols having only two reactive sites. Such resins may be prepared by reacting a para-substituted alkyl phenol with at least a 1:1 ratio of formaldehyde to phenol in the presence of an alkaline catalyst. The ratio of aldehyde to phenol is typically in the range of 1.2:1 to 1.6:1. A suitable phenol formaldehyde resin is a product of Union Carbide Corporation having the designation CK-1634.

Solvents suitable for preparation of the contact adhesive are $C_6$–$C_{10}$ aromatics such as benzene, toluene, xylene and hexane blends thereof, chlorinated hydrocarbons and petroleum solvents containing high percentages of aromatic and naphthenic constituents. Blends of napthas and ketones, or esters may also be used. Preferred solvents include toluene and 1,1,1-trichloroethane.

The ratio of polychloroprene to phenolic resin may be 0.5:1 to 2.5:1. The alkaline earth oxide may be included in an amount of 5 to 30 parts per hundred parts polychloroprene. The alkaline earth oxide may be prereacted in solution with the resin together with a small amount of water. The solvent may be present in the contact adhesive in an amount sufficient to permit application of the adhesive to the plastic sheet. Various modifications may be made in the composition of the adhesive so long as the adhesive produces a strong bond between the cured, wet-poured concrete and the plastic sheet.

An illustrative adhesive includes a blend of halogenated butyl rubber (i.e. polychloroprene), an alkaline earth metal oxide, a heat reactive phenol formaldehyde resin (or a terpene/phenolic resin) and an inert solvent. The adhesive may be provided as a liquid or solution including phenolic resin. The adhesive includes sufficient solvent to enable application of the adhesive to the liner.

One suitable liquid adhesive has been prepared by dissolving 5.91 parts t-butyl phenolic resin and 0.35 parts magnesium oxide in 17.64 parts 1,1,1-trichloroethane and then adding 0.09 parts water. As used herein, the terms parts, percent and the like will designate parts, percent and the like by weight unless otherwise indicated. Next, 50.08 parts 1,1,1-trichloroethane is added along with 8.82 parts polymerized 2-chloro-1,3-butadiene with 0.18 parts antioxidant. Finally, 16.93 parts perchlorethylene is added.

Such an adhesive has been found to provide excellent adhesion and any failure has occured within the concrete mass rather than between the adhesive and the concrete mass. Of course, various other contact adhesives may be used.

DETAILED DESCRIPTION OF THE STRUCTURAL UNIT

Figure 1:
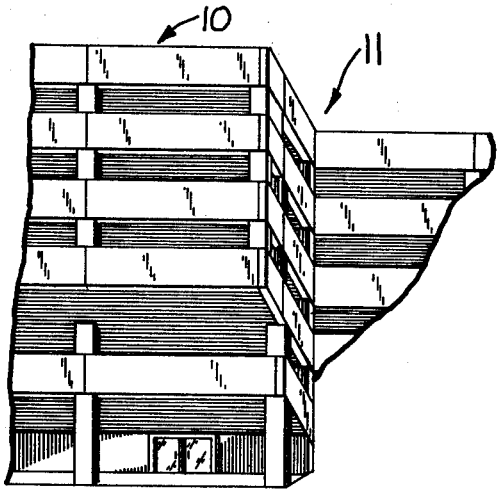
FIG. 1 shows a perspective view of a building incorporating the structural units of the present invention.

The structural unit 10 (FIG. 1) of the present invention may be a panel used in the construction of a building 11. The structural unit 10 may be disposed in any of various positions such as a horizontally disposed rectangle forming the front face of a building.

Figure 2:
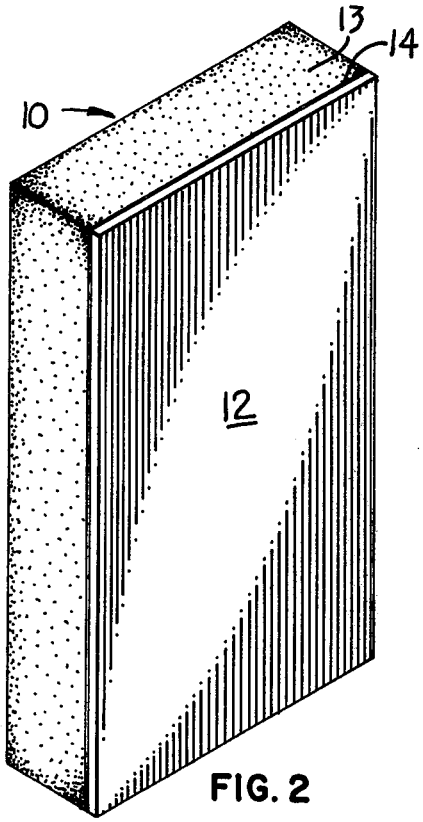
FIG. 2 is a front perspective view of an individual structural unit of the present invention.
Figure 3:
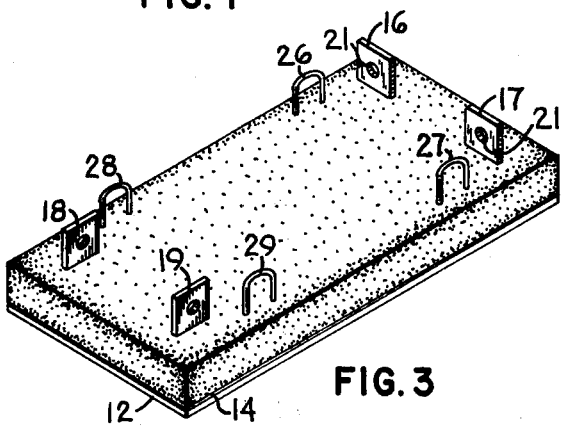
FIG. 3 is a rear prespective view of the structural unit of FIG. 2.

The structural unit 10 (FIGS. 1–3) includes a surface sheet 122 of plastic or thermoplastic material, a concrete sub-unit 13 and an adhesive layer 14. Adhesive layer 14 bonds sheet 12 to sub-unit 13. In this embodiment, the surface sheet 12 is planar in shape and may be of any desired color or colors. Moreover, the plastic sheet 12 may include surface shaping such as that providing a woodgrain or a leather effect.

The sub-unit 13 may include various hardware such as mounting flanges 16, 17, 18 and 19. The flanges 16–19 each include an opening 21 therein for the purpose of bolting the structural unit 10 into the building.

The structure 10 may include hardware such as U-shaped rod members 26, 27, 28 and 29 for handling the units. The handling members 26–29 are used for example, in removing the structural unit from the mold, loading the structural unit into crating or onto a carrier vehicle, as well as hoisting the structural unit to its appropriate position in the building.

Figure 4:
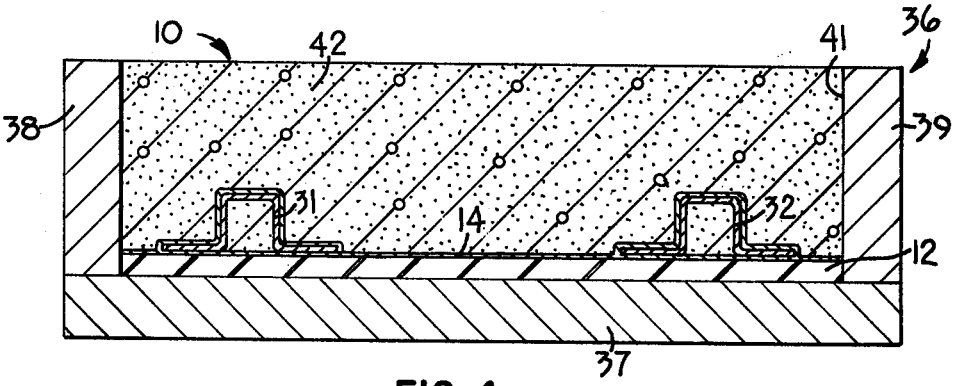
FIG. 4 is a cross-sectional view of a structural unit of the present invention while still in a mold.

The structural unit 10 may be prepared by coating the plastic sheet 12 with a suitable contact adhesive 14 (see FIG. 4). Reinforcing members 31 and 32 may be adhered to sheet 12 utilizing the contact adhesive 14. Further, the reinforcing members 31 and 32 may be hat bars which are likewise coated with the contact adhesive 14. The sheet 12 and reinforcing members 31, 32 may be placed in a mold 36.

The mold 36 may have a base plate 37 and a plurality of side plates such as 28, 29. For example, if the structural unit 10 is rectangular in shape, the mold 36 will include four side plates. The mold 36 provides a cavity 41 substantially the size of the desired structural unit 10. The sheet 12 is inserted in place and wet-mix concrete is poured into the mold preferably filling the mold to the upper edge of side plates 38 and 39. The concrete 42 is permitted to set or green cure. The unit 10 is then removed from the mold 36. If hardware such as members 16–19 and 26–29 is to be included, it is inserted into the wet concrete prior to setting thereof. The structural unit 10 after removal from mold 36 is permitted to complete curing.

Figure 5:
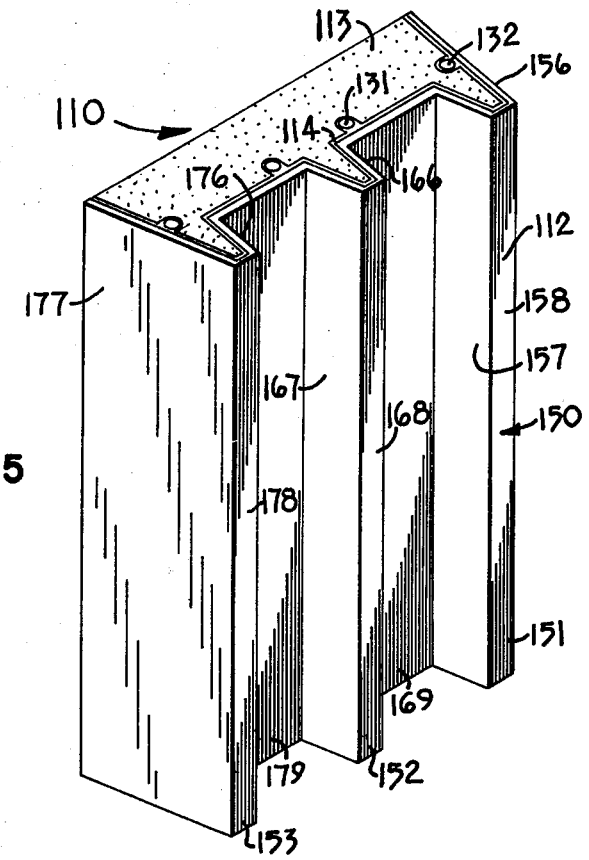
FIG. 5 is a cross-sectional view of another structural unit of the present invention.
Figure 6:
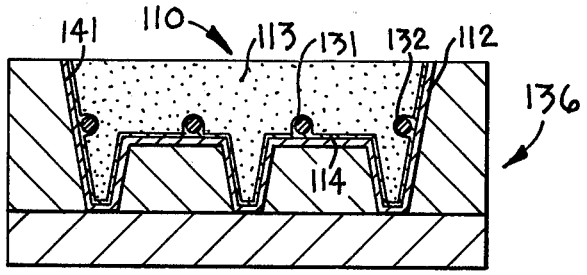
FIG. 6 is a cross-sectional view of the structural unit of FIG. 5 disposed in a mold.

An alternate structural unit 110 is shown in FIGS. 5 and 6. Structural unit 110 has a contoured face and includes a sheet 112 of plastic material, a concrete sub-unit 113 and a bonding layer of contact adhesive 114. The structural unit 110 may further include a plurality of reinforcing members such as deformed rods 131 and 132. The structural unit 110 has a face 150 including three spaced projections 151, 152 and 153. The projection 151 may have a pair of forwardly converging surfaces 156 and 157 and a front surface 158. Projection 152 may likewise include a pair of converging surfaces 166, 167 and a front surface 168. Surfaces 157 and 166 are interconnected by intermedia surface 169. The projection 153 has a pair of converging surfaces 176, 177 and a forward surface 178. Surfaces 167 and 176 are interconnected by intermediate surface 179.

The plastic sheet 112 may be formed into the desired shape by vacuum molding. In so doing, plastic sheet is heated until it becomes moldable. It is then drawn into a vacuum mold (not shown) of a shape conforming to the desired final shape of the sheet 112. The vacuum molded sheet is then permitted to cool until it becomes rigid. The sheet may be molded or formed by other techniques.

The structural unit 110 may include hardware similar to that described with regard to structural unit 10.

Structural unit 110 may be prepared in a one piece mold such as that shown in FIG. 6. The mold 136 has a cavity conforming to the size and shape of the molded sheet 112. The molded sheet 112 is placed in mold 136 and the reinforcing members 131, 132 may be adhered to the sheet 112 utilizing adhesive 114. Wet pourable concrete is next poured into the mold 136 substantially filling the cavity 141. The concrete is permitted to green cure and the structural unit 110 is removed from mold 136.

Figure 7:
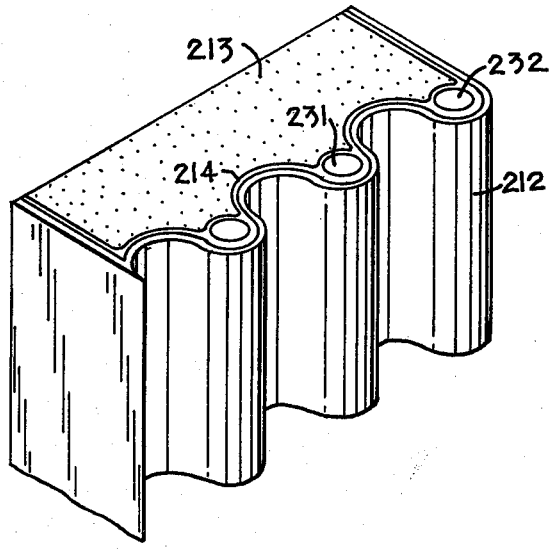
FIG. 7 is a perspective view of a further structural unit of the present invention.

A further embodiment 210 is shown in FIG. 7. The structural unit 210 may be similar in construction to the units 10 and 110; however, the exposed forward surface in this instance is corrugated in shape. The structural unit 210 may include a plastic sheet material 212 having a plurality of rolling curves. The structural unit 210 further includes a concrete sub-unit 213 and a plurality of reinforcing rods 231 and 232. The rods 231 and 232 may be deformed re-bars. A layer of contact adhesive is provided between sheet 212 and concrete sub-unit 213. Likewise the rods 231 and 232 may be coated with the adhesive 214. The structural unit 210 may be formed in a manner and by a method substantially like that described with regard to structural units 10 and 110 and therefore such methods will not be further described with regard to unit 210.

Of course, various modifications may be made without departing from the broader scope of the present invention. For example, the structural unit may have plastic sheet on two or more surfaces. The following examples are illustrative of the method of the present invention.

EXAMPLE I

A plastic covered concrete structural unit was prepared according to the present invention by first preparing a contact adhesive and applying such adhesive to a shaped plastic sheet. The shaped plastic sheet was placed in a mold and then wet-mix concrete was poured into the mold in association with the contact adhesive coating of the plastic film. The contact adhesive was prepared by combining, by weight, 17.64 parts 1,1,1-trichloroethane (chlorothene), 5.91 parts heat reactive t-butyl phenolic resin (a product of Union Carbide Corporation sold under the designation CK-1634), and 0.35 parts magnesium oxide (a product of Morton Chemical Company sold under the trademark Elastomag 170). Then 0.09 parts water were added with mixing until reaction took place. 50.08 parts 1,1,1-trichloroethane were added with mixing, next 8.82 parts polymerized 2-chloro-1,3-butadiene (Neoprene type W) and 0.18 parts antioxidant (zinc butyldithiocarbamate, a product of Pennsalt Chemicals Corp. sold under the trademark Butyl Ziram) were added and dissolved. Finally 16.93 parts perchloroethylene were added and intimately mixed. An oil soluble red dye was added for purposes of coloring the contact adhesive. The adhesive was applied to a vinyl sheet in an amount of approximately 0.006 inches in thickness. The adhesive was applied by brushing. The adhesive, following application, was dry to the touch. The coated film was then placed in a mold and wet concrete was poured thereon. The concrete was permitted to cure and the vinyl film was found to be strongly adhered to the concrete by the adhesive. The product was subjected to a plurality of freeze-thaw cycles by raising the temperature to 180° F and then lowering the temperature to −40° F; the film remained bonded to the concrete. The product was found to be highly satisfactory.

EXAMPLE II

A structure was prepared according to the present invention by first preparing a contact adhesive. The contact adhesive was prepared by adding 10.24 parts t-butyl phenolic resin and 0.61 parts magnesium oxide to 15.29 parts toluene. Then 0.15 parts acetic acid were added and thoroughly mixed. Toluene in an amount of 10.7 parts were added and blended in. Polymerized 2-chloro-1,3 butadiene in an amount of 15.29 parts, antioxidant in an amount of 0.31 parts and titanium dioxide in an amount of 1.53 parts were added. The adhesive was applied to a polyvinyl chloride film and the adhesive immediately became dry to the touch. The coated film was placed in a mold form and freshly mixed concrete wa poured into the mold in contact with the adhesive coated side of the film. The concrete was permitted to cure and a strong bond was obtained between the film and the concrete.

EXAMPLE III

A structure was prepared according to the present invention substantially as described in Example II; however, the adhesive was prepared by adding 7.45 parts polymerized 2-chloro-1,3 butadiene and 0.45 parts magnesium oxide to 11.12 parts toluene. Water in an amount of 0.11 parts was added with mixing. Toluene in an amount of 23.66 parts was added with blending. Next 42.83 parts lactol spirits (a solvent sold by American Mineral Spirits Company under the designation AMSCO Lactol Spirits W-1). Polymerized 2-chloro-1,3 butadiene in an amount of 11.12 parts, chlorinated isoprene (a product of Hercules sold under the trademark Parlon S-20) in an amount of 2.23 parts, antioxidant (a product of E. I. Dupont De Nemours and Co. sold under the trademark of Zalba Special) in an mount of 0.22 parts and titanium dioxide (a product of American Cyanamid Company sold under the trademark of Unitane OR-600) in an amount of 1.11 parts were added and dissolved. This contact adhesive provided an excellent bond between the cured concrete and the plastic film.

EXAMPLE IV

Two sets of plastic covered concrete structures were prepared according to the present invention substantially as described in Example 1 except the plastic film was ABS. A control of similar construction was prepared except it did not include a plastic sheet or film. The structures were prepared for purposes of testing flexural strength. The structures were rectangular in shape and suitable for testing flexural strength. The structures were each 3 inches by 4 inches by 16 inches. Set IV-A was a control and did not include the surface sheet. Set IV-B was identical to Set IV-A except provided with a sheet of ABS (acrylonitrile butadiene styrene) having a thickness of 0.16 centimeters. The adhesive formula was as described in Example I. Set IV-C was identical to set IV-B except further including standard ½ inch diameter steel reinforcing bars which were bonded to the ABS sheet with adhesive prior to pouring the concrete. The bars were centered on the ABS sheet and spaced 2 inches on center. The bars also were coated with the adhesive. Each of the sets was tested for flexural strength by supporting the individual sample on a pair of fulcrums. Each sample was loaded at the midpoint between the pair of fulcrums to determine the flexural strength. The results were as shown in the following Table

TABLE

BEAM FLEXURAL STRENGTH TEST

| Beam Construction | Number of Beams in the Set | Average Flexural Strength | Percent Improvement |
|---|---|---|---|
| Set IV-A (control-all concrete) | 6 | 309 p.s.i. | — |
| Set IV-B (ABS faced) | 3 | 706 p.s.i. | 228 |
| Set IV-C (ABS faced and reinforced) | 3 | 4,384 p.s.i. | 1,418 |

This testing shows that architectural structures prepared according to the present invention including adhesive bonded plastic lining alone or together with adhesive bonded reinforcing bars would possess substantially improved flexural strength over concrete architectural structures.

What is claimed is:

1. A method of preparing a composite structural unit including a plastic resinous surface sheet bonded to a concrete sub-unit, said method comprising: applying polychloroprene contact adhesive to one side of a plastic resinous sheet, drying said adhesive to the touch, disposing said plastic resinous sheet in a form retaining mold, said plastic sheet being disposed with the contact adhesive layer facing away from said mold; pouring wet settable concrete in said mold, said concrete engaging said adhesive; and curing said concrete.

2. The method of claim 1 wherein said contact adhesive comprises a phenolic resin and polychloroprene.

3. The method of claim 2 wherein said phenolic resin is t-butyl phenolic resin.

4. The method of claim 1 wherein said plastic resinous sheet comprises a polyvinylchloride film.

5. The method of claim 2 wherein reinforcement means are bonded to said sheet by contact adhesive prior to pouring said concrete.

6. The method of claim 5 wherein said reinforcement means are steel bars coated with contact adhesive.

7. A composite structural unit comprising plastic resinous sheet means, concrete sub-unit means, and a polychloroprene contact adhesive, said contact adhesive providing a bond between said sheet and said concrete, said plastic sheet having been coated on one side with said contact adhesive and said coated sheet and said concrete having been brought together after said adhesive was dry to the touch but while said concrete was still in a wet pourable uncured condition.

8. The structural units of claim 7 wherein said unit includes metal reinforcement, said metal reinforcement being bonded to said concrete by said contact adhesive.

9. The structural unit of claim 8 wherein said metal reinforcement is further bonded to said sheet.

* * * * *